US007442866B1

(12) United States Patent
Tsai

(10) Patent No.: US 7,442,866 B1
(45) Date of Patent: Oct. 28, 2008

(54) MOUTHPIECE FOR MUSICAL INSTRUMENT

(76) Inventor: Jui Hung Tsai, No. 91, Lane 219, Giahou Road, Houli, Taichung Hsien 42141 (TW)

( * ) Notice: Subject to any disclaimer, the term of this patent is extended or adjusted under 35 U.S.C. 154(b) by 0 days.

(21) Appl. No.: 12/002,858

(22) Filed: Dec. 19, 2007

(51) Int. Cl.
*G10D 7/00* (2006.01)

(52) U.S. Cl. ..... 84/380 R

(58) Field of Classification Search ..... 84/380 R, 84/381, 382, 383 A
See application file for complete search history.

(56) References Cited

U.S. PATENT DOCUMENTS 5,847,300 A * 12/1998 Hackl ..... 84/398
6,686,525 B1 2/2004 Wu ..... 83/383 R
6,747,198 B1 6/2004 Sullivan ..... 83/383 R
7,326,840 B2 * 2/2008 Wanne ..... 84/383 R

* cited by examiner

*Primary Examiner*—Kimberly R Lockett
(74) *Attorney, Agent, or Firm*—Charles E. Baxley

(57) ABSTRACT

A mouthpiece includes a mouthpiece member having a bore, a flat upper portion, an air conduit formed by an inclined bottom wall, and a reed attached to the flat upper portion for partially shielding the air conduit, a barrier plate is extended from the front end portion for forming an included angle between the barrier plate and the inclined bottom wall, and for forming an air passage between the barrier plate and the flat upper portion, and for forming a tone-altering compartment between the barrier plate and the inclined bottom wall, and for forming a tone-altering chamber behind the barrier plate and for altering the tone or for echoing purposes. A partition may be extended between with the barrier plate and the inclined bottom wall.

4 Claims, 3 Drawing Sheets

MOUTHPIECE FOR MUSICAL INSTRUMENT

BACKGROUND OF THE INVENTION

1. Field of the Invention

The present invention relates to a mouthpiece for such as a woodwind musical instrument, and more particularly to a mouthpiece including a tone-altering chamber formed therein for allowing the mouthpiece to be operated or vibrated in a harmonic resonance.

2. Description of the Prior Art

Typical mouthpieces comprise a tail or neck portion for attaching or coupling to a woodwind musical instrument, such as a saxophone, and a reed attached to the mouthpiece to control an air flowing through the mouthpiece.

For example, U.S. Pat. No. 6,686,525 to Wu, and U.S. Pat. No. 6,747,198 to Sullivan discloses one of the typical mouthpieces each comprising a reed for attaching to an air conduit of the mouthpiece in order to control the air flowing through the mouthpiece.

However, the typical mouthpieces have no tone-altering chambers formed therein such that the mouthpiece may not be operated or vibrated in a harmonic resonance.

The other typical mouthpieces may comprise a secondary reed for selectively engaging into the mouthpiece and for changing or altering the tone and for allowing the mouthpiece to be operated or vibrated in a harmonic resonance. However, it will be difficult to attach or engage or secure the secondary reed into the inner portion of the mouthpiece.

The present invention has arisen to mitigate and/or obviate the afore-described disadvantages of the conventional mouthpieces for the woodwind musical instruments.

SUMMARY OF THE INVENTION

The primary objective of the present invention is to provide a mouthpiece including a tone-altering chamber formed therein for allowing the mouthpiece to be operated or vibrated in a harmonic resonance.

In accordance with one aspect of the invention, there is provided a mouthpiece comprising a mouthpiece member including a bore formed therein, and including a flat upper portion, and including an air conduit formed in a front end portion thereof, and including an inclined bottom wall provided in the front end portion thereof for forming the air conduit, and a reed attached to the flat upper portion of the mouthpiece member for partially shielding the air conduit of the mouthpiece member, and the mouthpiece member includes a barrier plate extended from the front end portion of the mouthpiece member for forming an included angle between the barrier plate and the inclined bottom wall, and extended into the air conduit of the mouthpiece member for forming an air passage between the barrier plate and the flat upper portion of the mouthpiece member, and for forming a tone-altering compartment between the barrier plate and the inclined bottom wall, and for forming a tone-altering chamber behind the barrier plate and located in front of the bore of the mouthpiece member and communicating with the air passage and the tone-altering compartment and the bore of the mouthpiece member for altering the tone or for echoing purposes.

The mouthpiece member includes at least one orifice formed in the barrier plate for allowing the air to flow through the orifice of the barrier plate and into the tone-altering compartment of the mouthpiece member.

The mouthpiece member includes a partition extended downwardly from the barrier plate and toward the inclined bottom wall and located between the tone-altering compartment and the tone-altering chamber of the mouthpiece member for forming the tone-altering compartment and the tone-altering chamber of the mouthpiece member.

The mouthpiece member includes at least one aperture formed in the partition for allowing the air to flow through the aperture of the partition and for allowing the air to flow between the tone-altering compartment and the tone-altering chamber of the mouthpiece member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
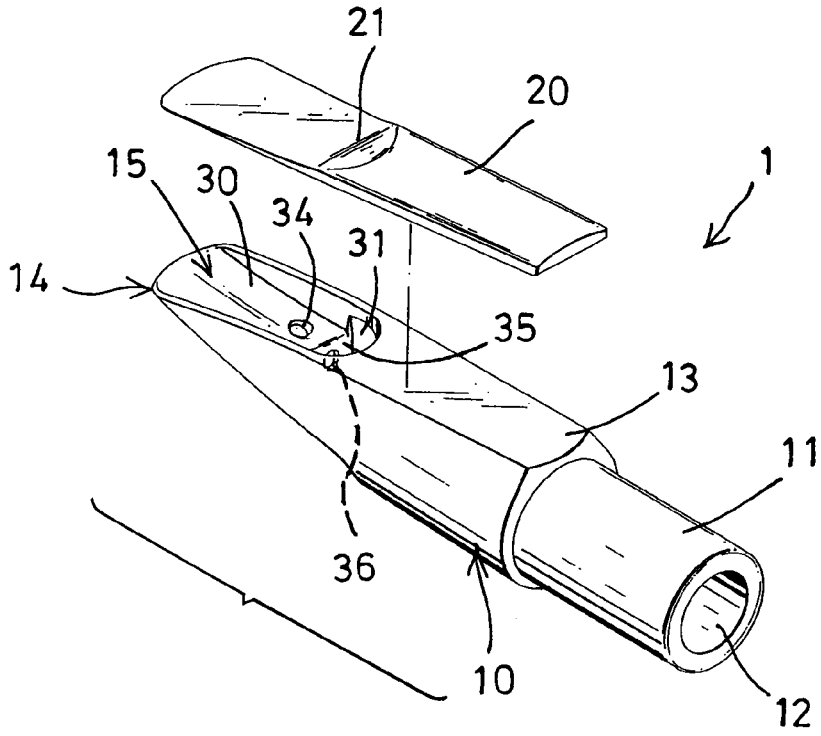
FIG. 1 is an exploded view of a mouthpiece in accordance with the present invention.
Figure 2:
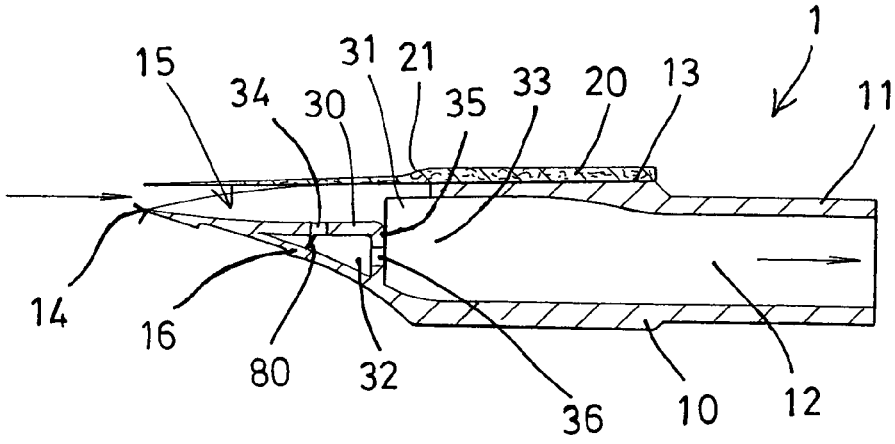
FIG. 2 is a cross sectional view of the mouthpiece.

Referring to the drawings, and initially to FIGS. 1 and 2, a mouthpiece 1 in accordance with the present invention comprises a mouthpiece body or member 10 including a tail or neck portion 11 formed or provided at one end or rear end portion thereof for attaching or coupling to a woodwind musical instrument (not shown), such as a saxophone, and including a bore 12 formed therein, and including a flat upper surface or portion 13 formed in the upper portion of the mouthpiece member 10 for attaching or engaging with a reed 20 which may include a peak 21, and the mouthpiece member 10 further includes an arcuate other end or front end portion 14, and includes an air conduit 15 formed in the other end or front end portion 14 thereof and formed or defined by an inclined bottom wall 16 and to be partially shielded by the reed 20. The above-described structure is typical and will not be described in further details.

The mouthpiece member 10 further includes a barrier plate 30 extended from the other end or front end portion 14 thereof into the air conduit 15 of the mouthpiece member 10 for forming an included angle 80 between the barrier plate 30 and the inclined bottom wall 16, but not extended into the bore 12 of the mouthpiece member 10 for forming or defining an air passage 31 between the barrier plate 30 and the flat upper portion 13 of the mouthpiece member 10, and for forming a tone-altering compartment 32 between the barrier plate 30 and the inclined bottom wall 16, and/or for forming a tone-altering chamber 33 behind the barrier plate 30 and located in the front portion of the bore 12 of the mouthpiece member 10 and communicating with the air passage 31 and the tone-altering compartment 32 and the bore 12 of the mouthpiece member 10. The mouthpiece member 10 may further include one or more orifices 34 formed in the barrier plate 30 for allowing the air to flow through the orifices 34 of the barrier plate 30 and into the tone-altering compartment 32 of the mouthpiece member 10.

The mouthpiece member 10 may further include a partition 35 extended downwardly from the rear end portion of the barrier plate 30 and toward the inclined bottom wall 16, and preferably formed integral with the barrier plate 30 and the inclined bottom wall 16, and located between the tone-altering compartment 32 and the tone-altering chamber 33 of the mouthpiece member 10, and/or for forming or defining the tone-altering compartment 32 and the tone-altering chamber 33 of the mouthpiece member 10. The mouthpiece member 10 may further include one or more apertures 36 formed in the partition 35 for allowing the air to flow through the apertures 36 of the partition 35 and for allowing the air to flow from the tone-altering compartment 32 into the tone-altering chamber 33 of the mouthpiece member 10 and for further altering the tone or for echoing purposes.

Figure 3:
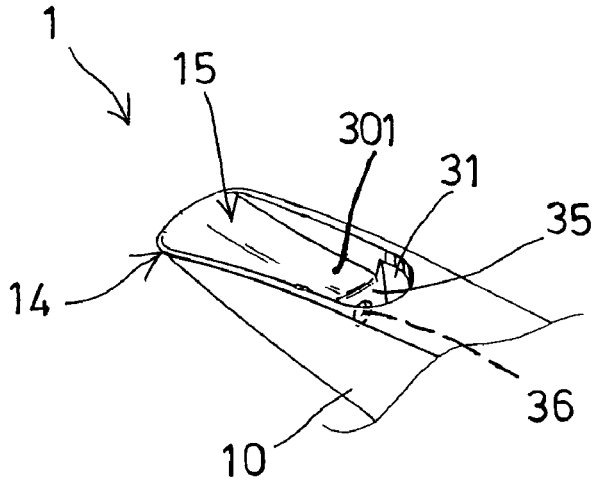
FIG. 3 is a partial perspective view illustrating the other arrangement of the mouthpiece.
Figure 4:
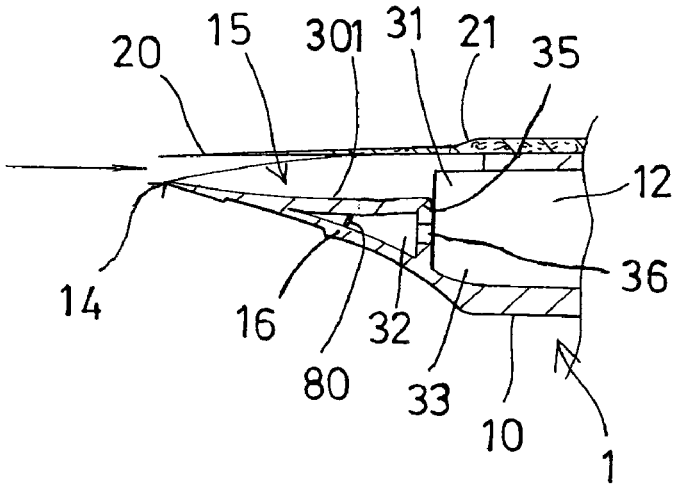
FIG. 4 is a partial cross sectional view of the mouthpiece as shown in FIG. 3.
Figure 5:
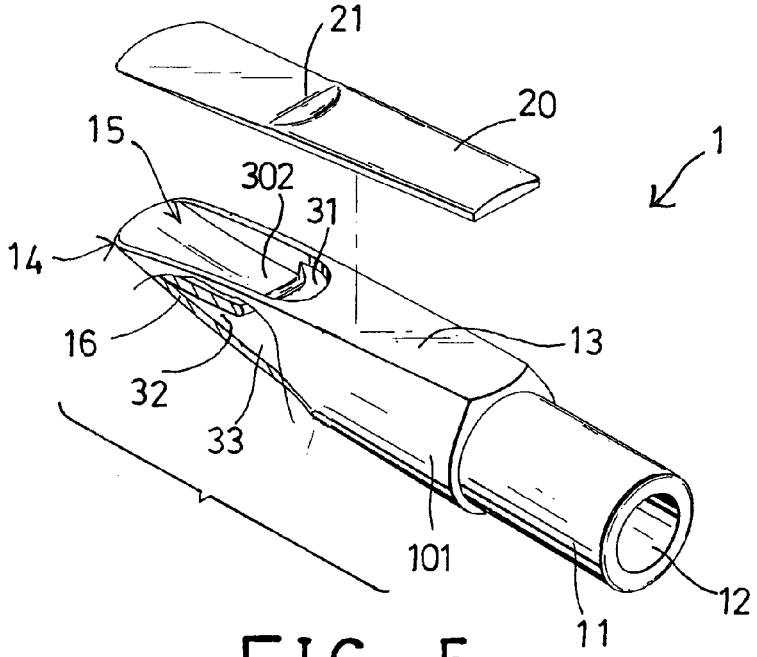
FIG. 5 is an exploded view similar to FIG. 1 illustrating the further arrangement of the mouthpiece.
Figure 6:
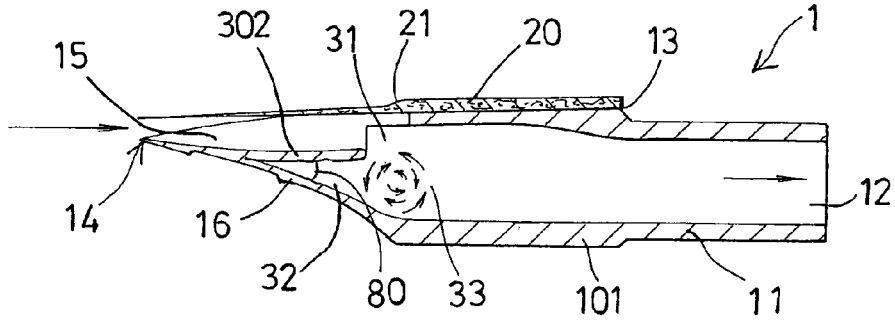
FIG. 6 is a cross sectional view of the mouthpiece as shown in FIG. 5.
Figure 7:
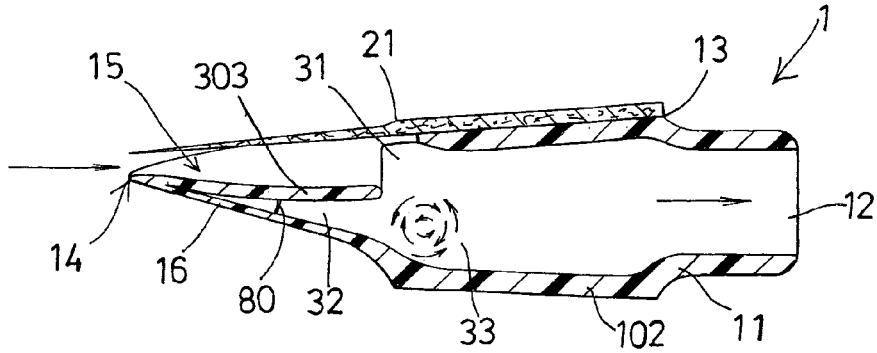
FIG. 7 is a further cross sectional view similar to FIGS. 2 and 6, illustrating the further arrangement of the mouthpiece.

Alternatively, as shown in FIGS. 3 and 4, the barrier plate 301 may include no orifices formed in the barrier plate 301 for allowing the air to flow into and out of the tone-altering compartment 32 only through the apertures 36 of the partition 35. Further alternatively, as shown in FIGS. 5 and 6, the mouthpiece member 101 may include no partition 35 extended therein, and may include no orifices formed in the barrier plate 302 for allowing the air to flow freely between the tone-altering compartment 32 and the tone-altering chamber 33 of the mouthpiece member 10. Further alternatively, as shown in FIG. 7, the mouthpiece member 102 may be formed by such as the molding or mold injection processes for allowing the barrier plate 303 and the inclined bottom wall 16 and the mouthpiece member 102 to be easily and quickly formed integral with each other.

In operation, as shown in FIG. 2, the air is allowed to flow into and through the air conduit 15 formed or defined between the barrier plate 30 and the reed 20, and to flow through the air passage 31 and into the bore 12 of the mouthpiece member 10 for altering the tone or for echoing purposes. The air is also allowed to partially flow through the orifices 34 of the barrier plate 30 and into the tone-altering compartment 32 for further altering the tone or for echoing purposes. The air is also allowed to partially flow through the apertures 36 of the partition 35 and into the bore 12 of the mouthpiece member 10 for further altering the tone or for echoing purposes. The mouthpiece member 10 may be formed or made by such as bamboo, wood, metal, or plastic materials, or other synthetic materials.

Accordingly, the mouthpiece in accordance with the present invention includes a tone-altering chamber formed therein for allowing the mouthpiece to be operated or vibrated in a harmonic resonance.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mouthpiece comprising:

a mouthpiece member including a bore formed therein, and including a flat upper portion, and including an air conduit formed in a front end portion thereof, and including an inclined bottom wall provided in said front end portion thereof for forming said air conduit, and a reed attached to said flat upper portion of said mouthpiece member for partially shielding said air conduit of said mouthpiece member, and said mouthpiece member including a barrier plate extended from said front end portion of said mouthpiece member for forming an included angle between said barrier plate and said inclined bottom wall, and extended into said air conduit of said mouthpiece member for forming an air passage between said barrier plate and said flat upper portion of said mouthpiece member, and for forming a tone-altering compartment between said barrier plate and said inclined bottom wall, and for forming a tone-altering chamber behind said barrier plate and located in front of said bore of said mouthpiece member and communicating with said air passage and said tone-altering compartment and said bore of said mouthpiece member.

2. The mouthpiece as claimed in claim 1, wherein said mouthpiece member includes at least one orifice formed in said barrier plate for allowing the air to flow through said at least one orifice of said barrier plate and into said tone-altering compartment of said mouthpiece member.

3. The mouthpiece as claimed in claim 1, wherein said mouthpiece member includes a partition extended downwardly from said barrier plate and toward said inclined bottom wall and located between said tone-altering compartment and said tone-altering chamber of said mouthpiece member for forming said tone-altering compartment and said tone-altering chamber of said mouthpiece member.

4. The mouthpiece as claimed in claim 3, wherein said mouthpiece member includes at least one aperture formed in said partition for allowing the air to flow through said at least one aperture of said partition and for allowing the air to flow between said tone-altering compartment and said tone-altering chamber of said mouthpiece member.

* * * * *